US007278479B2

(12) United States Patent
Kvernstuen et al.

(10) Patent No.: US 7,278,479 B2
(45) Date of Patent: Oct. 9, 2007

(54) DOWNHOLE CABLE PROTECTION DEVICE

(75) Inventors: Ole S. Kvernstuen, Sandnes (NO); Kjartan Roaldsnes, Kvernaland (NO)

(73) Assignee: Reslink AS (NO)

( * ) Notice: Subject to any disclaimer, the term of this patent is extended or adjusted under 35 U.S.C. 154(b) by 172 days.

(21) Appl. No.: 10/474,589

(22) PCT Filed: Apr. 5, 2002

(86) PCT No.: PCT/NO02/00132

§ 371 (c)(1),
(2), (4) Date: Mar. 25, 2004

(87) PCT Pub. No.: WO02/081862

PCT Pub. Date: Oct. 17, 2002

(65) Prior Publication Data

US 2004/0149428 A1 Aug. 5, 2004

(30) Foreign Application Priority Data

Apr. 10, 2001 (NO) ..... 20011808

(51) Int. Cl.
*E21B 43/08* (2006.01)

(52) U.S. Cl. ..... 166/234; 166/227; 166/241.6

(58) Field of Classification Search ..... 166/241.5, 166/241.6, 234, 227
See application file for complete search history.

(56) References Cited

U.S. PATENT DOCUMENTS 4,096,911 A 6/1978 Geske
5,515,915 A 5/1996 Jones et al.
6,554,064 B1 * 4/2003 Restarick et al. ..... 166/250.01
6,595,284 B2 * 7/2003 Davis ..... 166/241.4
6,681,854 B2 * 1/2004 Danos ..... 166/227
6,684,951 B2 * 2/2004 Restarick et al. ..... 166/250.01
6,817,410 B2 * 11/2004 Wetzel et al. ..... 166/233

FOREIGN PATENT DOCUMENTS

EP 0 622 523 11/1994

* cited by examiner

*Primary Examiner*—David Bagnell
*Assistant Examiner*—Robert Fulller
(74) *Attorney, Agent, or Firm*—Andrus, Sceales, Starke & Sawall, LLP

(57) ABSTRACT

A device for an underground well, typically a petroleum well (1), wherein, in the uncased inflow portion (2, 4, 6) of the well, there is placed an inflow pipe, possibly in the form of a strainer pipe (8) comprising a strainer/perforated outer mantle (16), a main pipe (12) located within and a number of preferably axial spacer strips (18) spaced apart about the external periphery of the main pipe and arranged to support the strainer mantle (16), whereby there are, in the space defined by the strainer mantle (16) and the main pipe (12), channels 20 between the spacers (18), and in one or more of the channels 20, there extends at least one cable, pipe or hose (34, 38).

1 Claim, 5 Drawing Sheets

DOWNHOLE CABLE PROTECTION DEVICE

CROSS REFERENCE TO RELATED APPLICATION

The present application is the U.S. national stage application of International Application PCT/NO02/00132, filed Apr. 5, 2002, which international application was published on Oct. 17, 2002 as International Publication WO 02/081862. The International Application claims priority of Norwegian Patent Application 20011808, filed Apr. 10, 2001.

BACKGROUND OF THE INVENTION

This invention relates to a device which forms a protected passage for communication cables, pipes or hoses in the well fluid inflow portion of production tubing in wells of the kind used in the recovery of petroleum.

In recent years, in particular when horizontal wells are used, it has become usual to use the so-called "open hole" technique. The technique involves that in a portion of the well, typically in one or more of the petroleum-producing zones of the reservoir, no casing is set. Thus, when the production tubing is to be run, it must be moved into and through an open well bore, within which it lies slidingly against the well formation. To prevent sand from the formation from entering together with the inflowing well fluid, and to support the formation wall and thus prevent the well bore from collapsing, it is common to set so-called strainer pipes in the petroleum-producing zones of the reservoir. In their outer jacket, the strainer pipes are provided with through openings in the form of fine bores or slots designed to admit well fluid but prevent formation sand from reaching the production tubing located within.

The development of the production technique in question has resulted in the discovery of an increasing requirement for using downhole sensors and actuators. Sensors are used, for example, for measuring one or more of the physical properties of the well fluid, whereas actuators may be used, for example, for choking well fluid from one or more of the zones of the reservoir. Communication between such downhole equipment and the surface is normally accomplished by means of electrical cables, whereas energy is supplied by means of electrical wires and/or hydraulic pipe or hose connections.

According to known technique, cables and pipes or hoses of the kind in question are placed in protective channels arranged for the purpose externally on the strainer pipe. It is obvious that when production tubing is being run, as the strainer pipes are subjected to displacement and rotation against the uncased formation, such protective channels are subjected to huge mechanical loads. Experience goes to show that during the running operation damage will occur, to a considerable extent, on these protective channels and the cables, pipes or hoses carried inside the channels.

SUMMARY OF THE INVENTION

The invention has as its object to remedy the drawbacks of known technique.

The object is achieved according to the invention through the features specified in the description below and in the following claims.

A strainer pipe normally comprises an external, relatively thin-walled strainer mantle and an internal, relatively strong perforated load-carrying main pipe. The strainer mantle, which may be constructed from strainer wire, is supported concentrically by spacers, possibly in the form of a number of longitudinal spacer rails spaced along the periphery of the production tubing. The spacer rails are thus within an annular space between the strainer mantle and the main pipe.

During production well fluid enters through the openings of the strainer mantle, through the annular space along the spacer rails and further through the perforations of the main pipe into the cavity of the main pipe, after which the fluid flows to the surface through the production tubing of the well.

To avoid the above-mentioned drawbacks of the known technique, cables and hydraulic connections are placed in one or more longitudinal pipes present in the annular space between the strainer mantle and the main pipe. In such a solution the protective devices of cables and hydraulic connections are subjected to minimal mechanical load, while at the same time they reduce the flow area available for well fluid only to an insignificant degree.

It is common to join together several strainer pipes which may form a length corresponding to the length of the producing zone of the reservoir. The annular space of each of the strainer pipes may be connected to the annulus of the adjacent pipe by means of sleeves of a kind known in itself, wherein the sleeves may be provided with external openings.

In some applications cables and hydraulic connections may be placed in said annular space without the use of longitudinal pipes.

The device is also well suited for use in wells provided with a cemented and perforated liner.

BRIEF DESCRIPTION OF THE DRAWINGS

In the following will be described a non-limiting example of a preferred embodiment which is visualized in the accompanying drawings, in which.

DETAILED DESCRIPTION OF THE INVENTION

Figure 1:
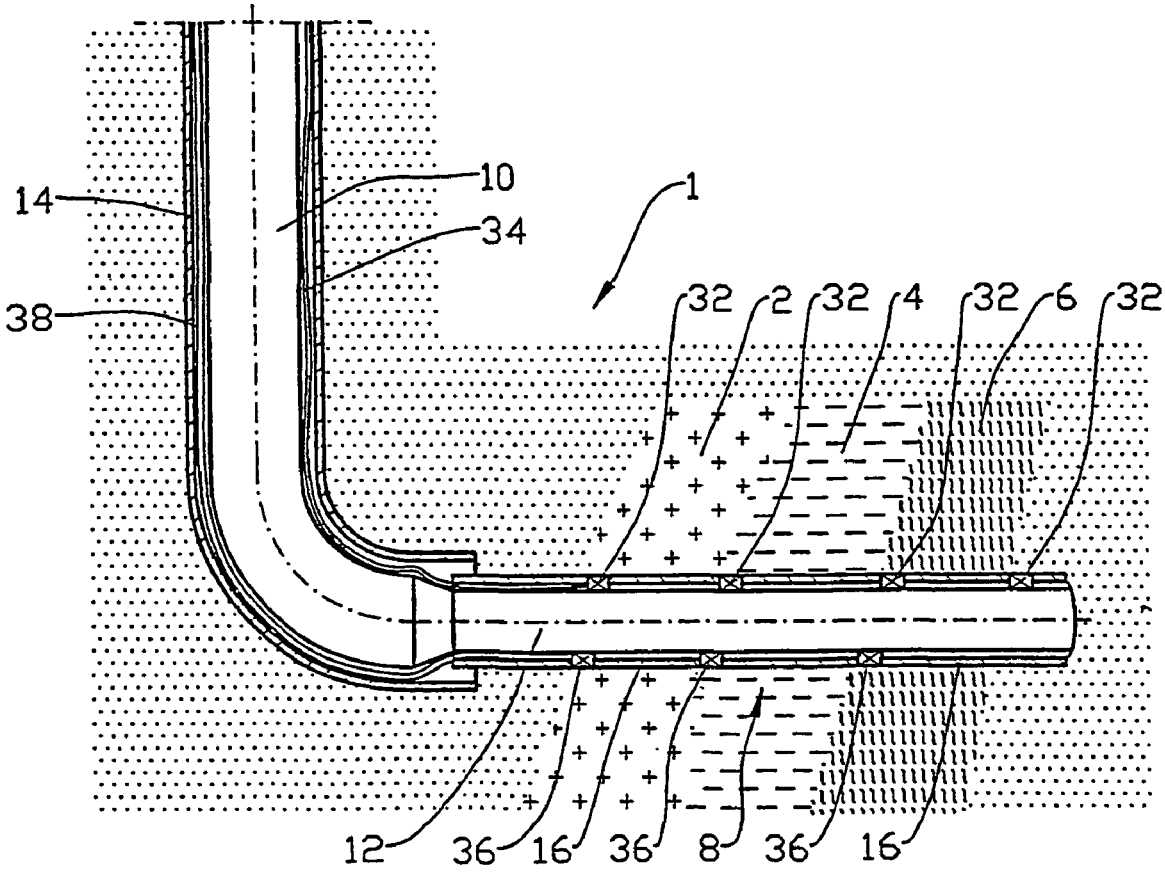
FIG. 1 shows schematically a petroleum well comprising an uncased well part, in which there are placed several downhole sensors and actuators, communicating with the surface through cables, pipes or hoses.
Figure 2:
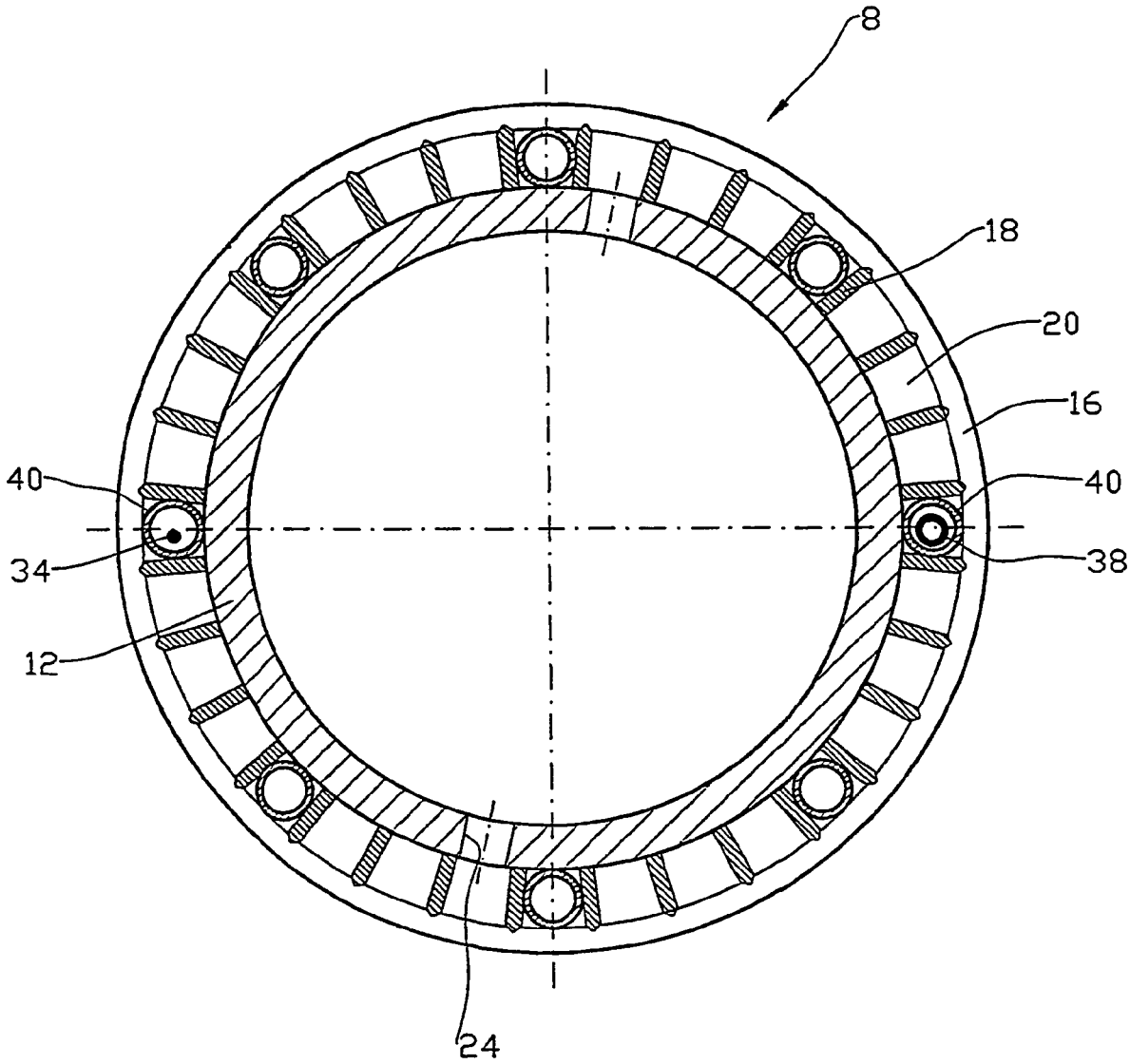
FIG. 2 shows a sectional view of a strainer pipe, in which there are, in the annular space between the strainer mantle and the main pipe and in addition to spacer rails, a number of passage pipes for cables, pipes or hoses.
Figure 3:
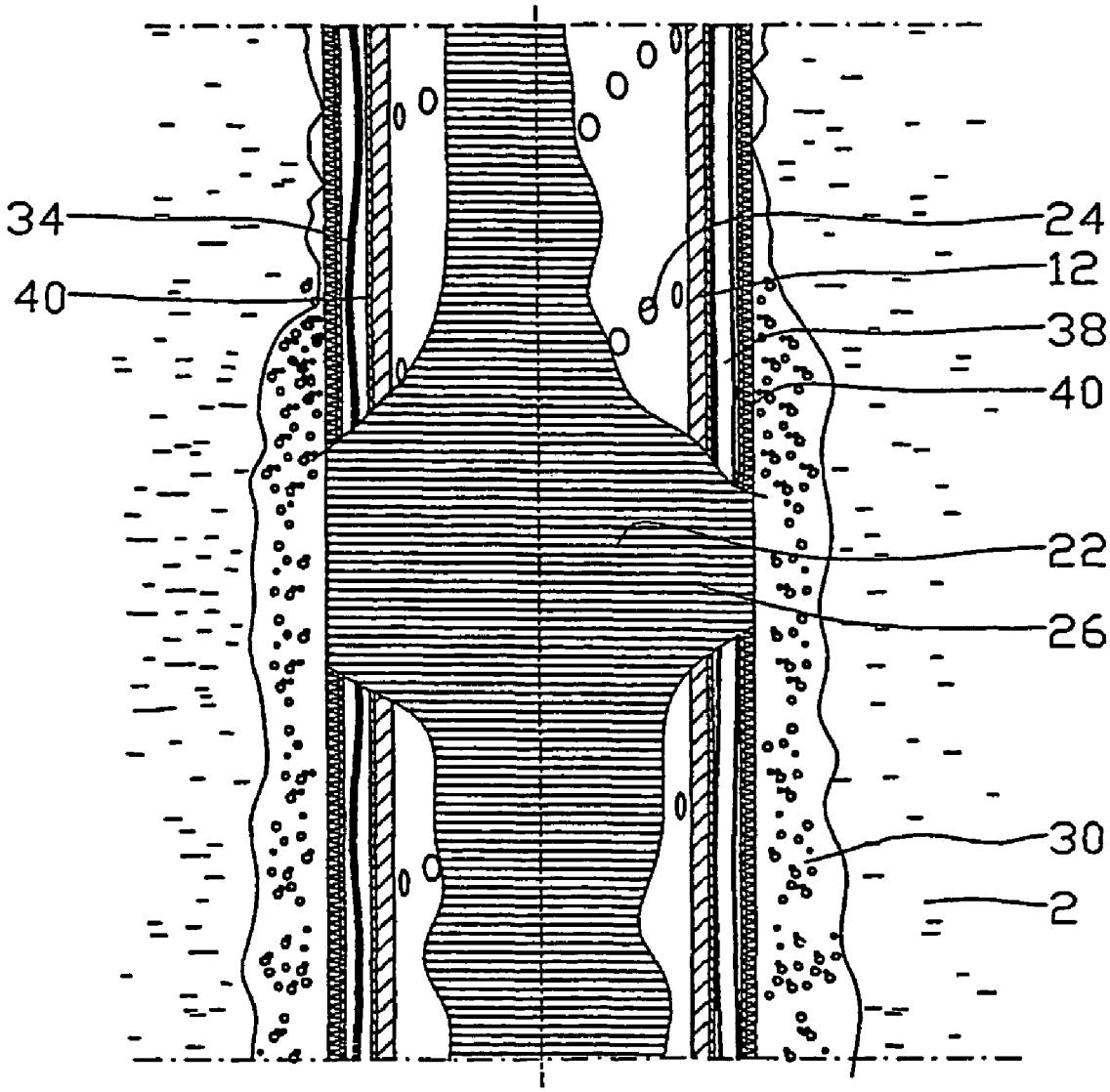
FIG. 3 shows, partially in section, a side view of a strainer pipe which is placed in an uncased formation and in which the strainer mantle is formed by a spun strainer wire.
Figure 4:
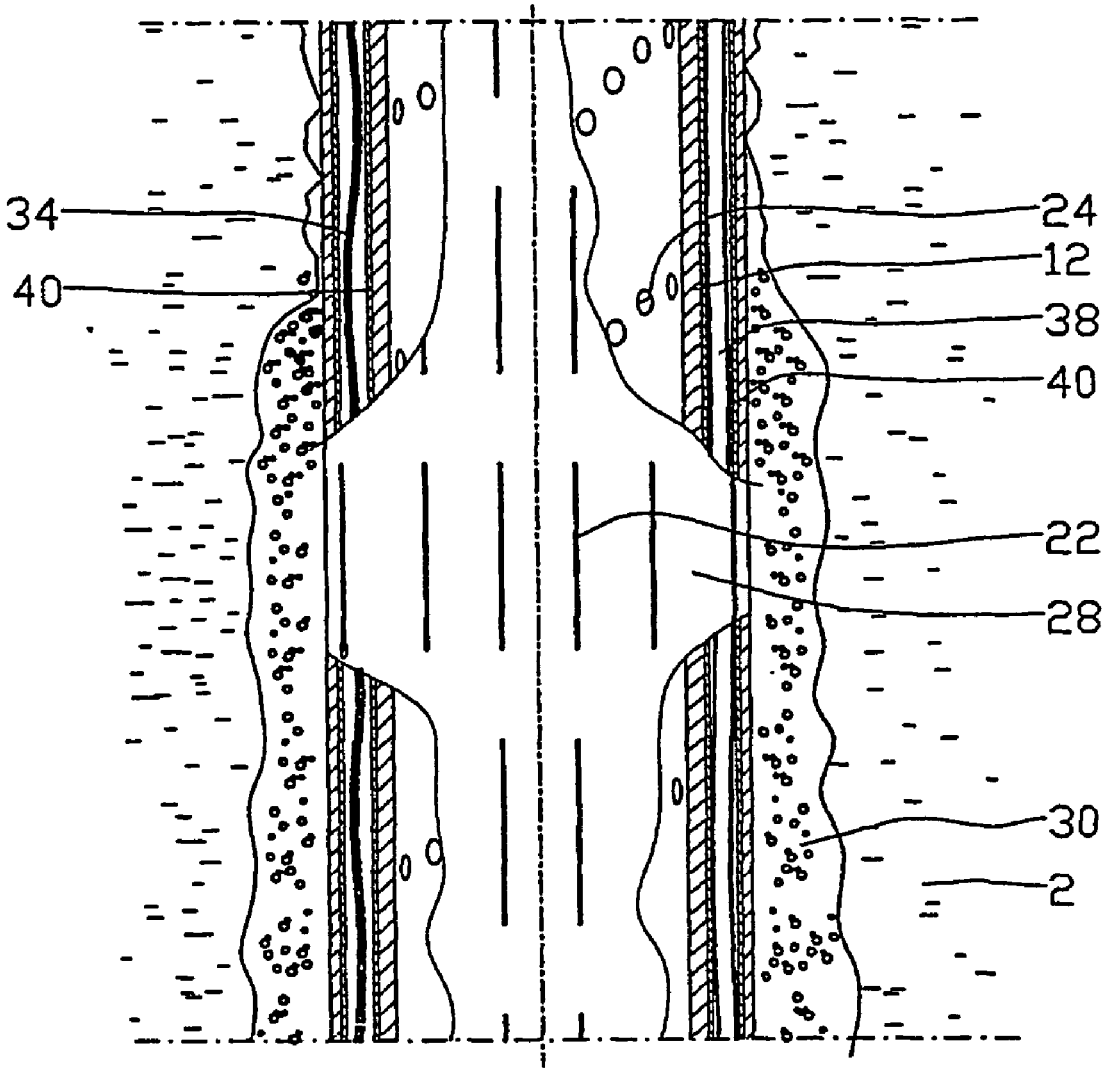
FIG. 4 shows, partially in section, a side view of a strainer pipe which is placed in an uncased formation and in which the strainer mantle is formed by a slotted pipe.

In the drawings the reference numeral 1 identifies a petroleum well, there being placed, in the uncased petroleum-producing zones 2, 4, 6 of the well 1, a number of interconnected strainer pipes 8. Well fluid flows from the well 1 to the surface through a production tubing 10 which is connected to the central main pipe 12 of the strainer pipe 8. The production tubing 8 extends through the casing 14 of the well 1.

In a preferred embodiment, the strainer pipe 8 comprises besides the main pipe 12, a strainer mantle 16 and a number of continuous or slotted spacer strips 18 spaced apart about the periphery of the main pipe 12 and arranged to support the strainer mantle 16. In the annular space between the strainer mantle 16 and the main pipe 12 there are, depending on the number of spacer strips 18, a number of longitudinal channels 20, through which well fluid is flowing on its way from the slots 22 of the strainer mantle 16 to the perforations 24 of the main pipe. The slots 22 may be formed by means of, for example, a spun strainer wire 26 or a slotted mantle pipe 28.

It is common to fill the annulus formed between the uncased well portion and petroleum producing zones 2, 4, 6 with gravel 30 with the aim of contributing to the prevention of sand entrance and formation damage.

The well in FIG. 1 is provided with a number of sensors 32 communicating with the surface through a cable 34, and a number of actuators 36 supplied with hydraulic or electrical energy through pipes, cables or hoses 38. In the well portion where a strainer pipe 8 is used, the cable 34 and the pipes or hoses 38 extend through fluid tight protective pipes 40 located in one or more of the channels 20, whereas in the upper portion of the well 1 they extend through the annulus formed between the casing 12 and the production tubing 10 up to the surface. The protective pipe 40 may possibly replace a spacer rail 18.

Figure 5:
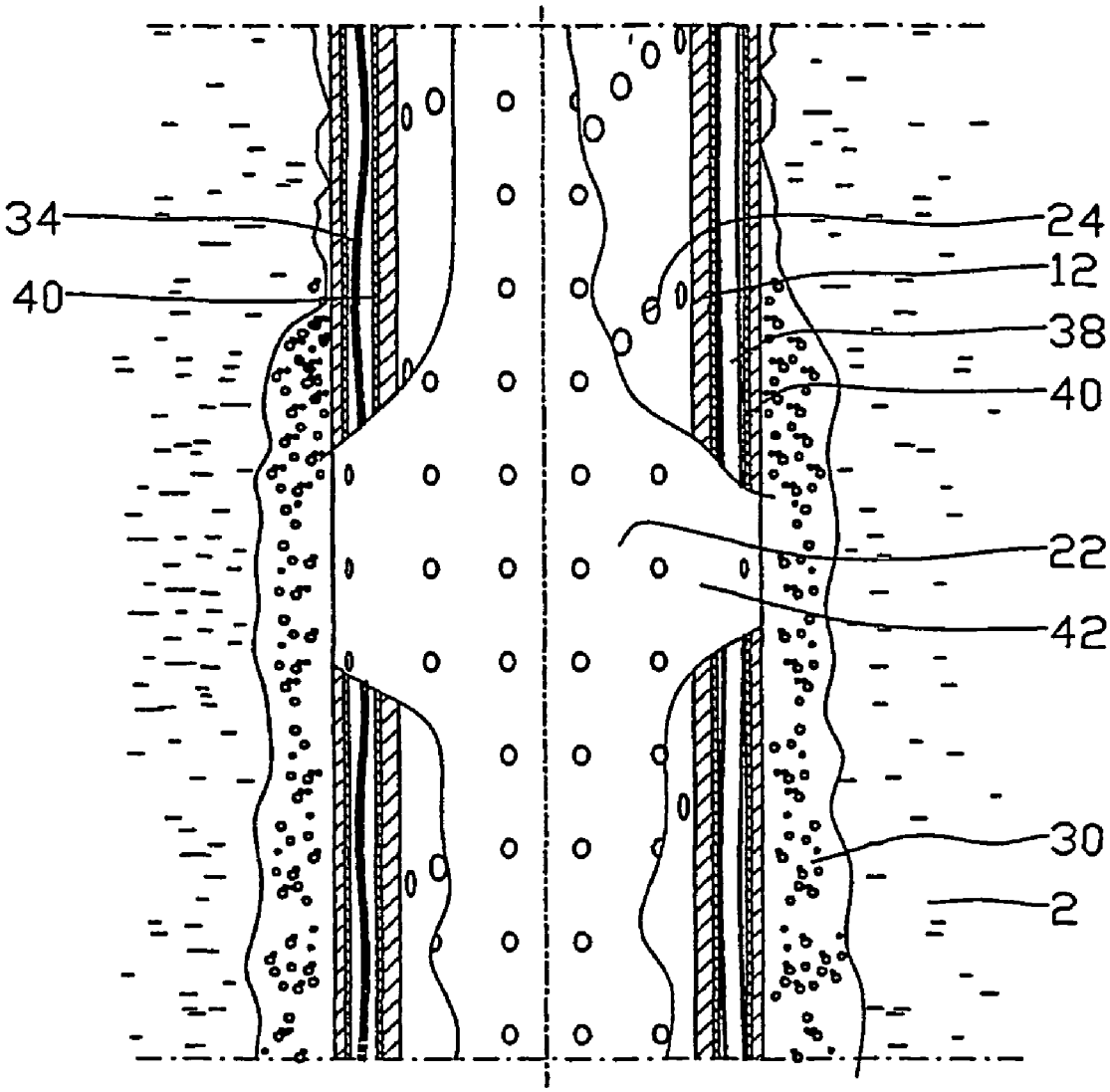
FIG. 5 shows, partially in section, a side view of a perforated pipe placed in an uncased formation, but the construction of the pipe otherwise exhibiting the same features as those shown in FIG. 2.

In another embodiment, essentially based on the technique described above, the strainer pipe 8 is provided with a perforated mantle pipe 42, see FIG. 5.

By placing the protective pipes 40 in the channels 20, the protective pipes 40 are only exceptionally subjected to mechanical loads, whereby wires, pipes or hoses 34, 38 located within the protective pipes 40 are completely shielded from external loads.

The invention claimed is:

1. A device for use in a fluid producing, underground well (1) having an inflow portion (2, 4, 6), said device comprising:

a perforated, main pipe (12) suitable for insertion into the inflow portion of the well;

a strainer comprising a pervious outer mantle (16) surrounding said main pipe;

a plurality of axially extending spacer means (18) spaced about an external periphery of said main pipe and arranged to support the strainer mantle (16) on said main pipe, said spacer means forming channels (20) between the spacer means in an annular space defined by the strainer mantle (16) and the main pipe (12); and a hydraulic pipe extending through at least one of said channels and between the spacers and coupled to an actuator (36) located proximate the inflow portion, the hydraulic pipe providing the actuator (36) with energy;

wherein said spacer means comprises a plurality of axially extending spacer strips (18).

* * * * *